US006554181B1

(12) United States Patent
Dammers et al.

(10) Patent No.: US 6,554,181 B1
(45) Date of Patent: Apr. 29, 2003

(54) RECLOSABLE POURING ELEMENT AND A FLAT GABLE COMPOSITE PACKAGING PROVIDED THEREWITH

(75) Inventors: Matthias Dammers, Alsdorf (DE); Holger Schmidt, Baseweiler (DE)

(73) Assignee: SIG Combibloc GmbH & Co. KG, Linnich (DE)

( * ) Notice: Subject to any disclaimer, the term of this patent is extended or adjusted under 35 U.S.C. 154(b) by 0 days.

(21) Appl. No.: 09/601,677

(22) PCT Filed: Feb. 5, 1999

(86) PCT No.: PCT/EP99/00785

§ 371 (c)(1),
(2), (4) Date: Dec. 22, 2000

(87) PCT Pub. No.: WO99/39984

PCT Pub. Date: Aug. 12, 1999

(30) Foreign Application Priority Data

Feb. 9, 1998 (DE) ..... 198 05 030

(51) Int. Cl.[7] ..... B65D 5/74; B65D 17/34

(52) U.S. Cl. ..... 229/125.04; 220/267; 220/326; 220/825; 220/833; 220/834; 229/123.3; 229/125.09; 229/125.15

(58) Field of Search ..... 229/123.2, 123.3, 229/125.04, 125.09, 125.14, 125.15, 125.17, 204, 221; 220/266, 267, 324, 326, 810, 825, 833, 834

(56) References Cited

U.S. PATENT DOCUMENTS

| | | | | | |
|---|---|---|---|---|---|
| 4,915,290 | A | * | 4/1990 | Ribichaud et al. | 229/125.14 |
| 4,925,034 | A | * | 5/1990 | Robichaud et al. | 220/267 |
| 4,930,683 | A | * | 6/1990 | Farber | 229/125.09 |
| 5,101,999 | A | * | 4/1992 | Robichaud et al. | 229/125.09 |
| 5,108,029 | A | * | 4/1992 | Abrams et al. | 220/266 |
| 5,632,440 | A | * | 5/1997 | Tragardh et al. | 229/123.2 |
| 5,806,757 | A | * | 9/1998 | Per et al. | 229/204 |
| 5,875,959 | A | * | 3/1999 | Weiteder et al. | 229/125.09 |
| 5,947,316 | A | * | 9/1999 | Guillonnet | 229/204 |
| 6,257,449 | B1 | * | 7/2001 | Baerenwald | 229/204 |

FOREIGN PATENT DOCUMENTS

| | | | | |
|---|---|---|---|---|
| DE | 4409947 | A1 * | 9/1995 | |
| DE | 4409947 | | 7/1997 | |
| DE | 19635087 | | 10/1997 | |
| DE | 19635087 | C1 * | 10/1997 | |
| EP | 0658480 | | 12/1994 | |
| EP | 658480 | A1 * | 6/1995 | |
| JP | 64-9152 | A * | 1/1989 | 229/125.17 |

* cited by examiner

*Primary Examiner*—Gary E. Elkins
(74) *Attorney, Agent, or Firm*—Standley & Gilcrest LLP

(57) ABSTRACT

A reclosable pouring element with a base member and a closure lid which serves at the same time as the opening device. A flange surrounding the opening surface of the pouring element is fixedly connected to a flat gable top composite packaging. The closure lid has lateral bearing pins which are supported in corresponding recesses of the base member, in which a safe connection between the base member and the closure lid and a reliable opening/closing function of the flat gable top composite packaging is provided. The recesses in the base member are arranged on the package side so that the closure lid can be clamped from the package side into the recesses for receiving the bearing pins provided in the base member.

11 Claims, 2 Drawing Sheets

FIG-4
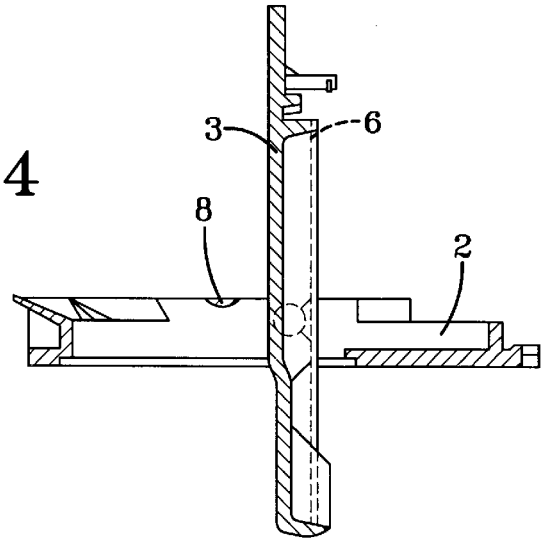
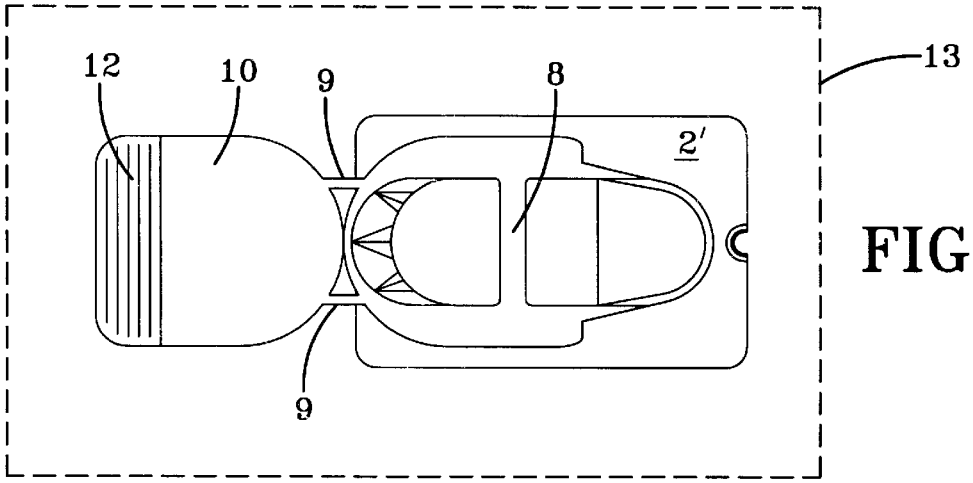
FIG-5
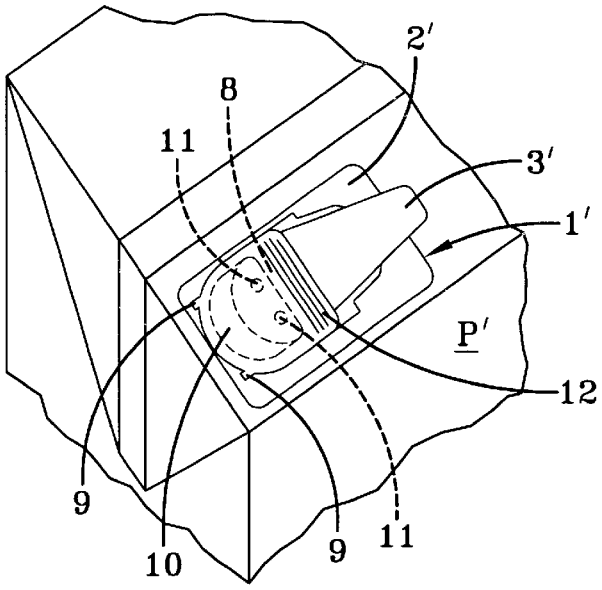
FIG-6

RECLOSABLE POURING ELEMENT AND A FLAT GABLE COMPOSITE PACKAGING PROVIDED THEREWITH

BACKGROUND AND SUMMARY OF THE INVENTION

The invention relates to a reclosable pouring element with a base member and a closure lid which at the same time serves as an opening means, wherein a flange surrounding the opening surface of the pouring element is fixedly connected to the flat gable top composite packaging, and wherein the closure lid has lateral bearing pins which are supported in corresponding recesses of the base member, and relates as well to a flat gable top composite packaging provided with such a pouring element.

Parallelepipedal flat gable top composite packagings are known in several embodiments. They are used primarily in the field of liquid packagings in connection with cold, cold-sterile, hot, and aseptic fillings. These packagings, in general, cannot be reclosed once they have been opened.

Accordingly, it has been proposed for flat gable top composite packagings of the aforementioned kind to arrange a pouring element within the packaging gable which is provided with a corresponding closure lid and by which the packaging is also opened before the first use (DE 38 08 303 A1). In this connection, in the area of the carton layer and the outer PE layer a circumferential separation line for weakening the gable material is provided into which a tube, connected as a unitary part with the closure lid and matching the shape of the circumferential separation line, is pressed into the packaging material for opening the packaging. For improving the separation of the weakened separation line, the lower edge of the tube is provided for this purpose with suitable mechanical opening means such as cutting edges etc.

Another reclosable pouring element is known from DE 44 09 947 C2 of the applicant. In order to provide in this design a safe connection between the pouring element and the flat gable top packaging, the pouring element used in this design is formed such that the portion of the flange of the pouring element facing the gable seam extends up to the gable seam and approximately into the area of the bending edge of the packaging ear and is secured between the packaging surface and the folded-over gable seam. This is not only disadvantageous with respect to material use and expenditure during injection molding of the pouring element but, moreover, the pouring element can be arranged only on that side of the packaging surface onto which the gable seam is folded.

A disadvantage of this known reclosable pouring element is the connection between the base member and the closure lid. Since the closure lid is clamped with its lateral bearing pins from above into the base member, it cannot be reliably excluded that during the opening movement the closure lid is levered out of its securing elements by means of the resistance of the composite material. It is easily understood that the recesses for receiving the bearing pins will be deformed by several passes of the bearing pins when pressing the closure lid into and out of the base member so that the functional reliability is impaired during the subsequent opening and closing of the opened packaging.

Moreover, from DE 196 35 087 C1 a reclosable pouring element with a closable lid and an opening element for penetrating the packaging wall at a prepared weakened zone is known, in which the opening element as well as the lid are supported to be pivotable about a respective axis of the base member of the pouring element and are connected functionally with one another such that the actuation of the opening element at the same time results in a folding open of the lid. The bearing pins required for supporting the opening element and the lid are inserted from the packaging side into longitudinal slots in the base member of the pouring element. For realizing a simultaneous folding open of the lid upon actuation of the opening element, a relatively complex connection between the lid and the opening element is required which makes the manufacture of the pouring element more difficult.

Finally, from DE 38 08 303 A1 a reclosable pouring element is known whose lid, in a transport position, is connected to the base element by a securing ring with a pull tab. The securing ring surrounds the circumference of the lid and must be removed before the initial opening of the packaging by means of the pull tab so that already during the first opening step of the packaging a throw-away part results that must be separately disposed of.

The present invention has the object to improve the known and previously described reclosable pouring element in its entirety and to provide especially a safe connection between the base member and the closure lid. Moreover, it is desirable to achieve an improvement of handling and a reliable opening/closing function of the flat gable packaging.

The present invention provides a reclosable pouring element with a base member and a closure lid for flat gable packaging, wherein the recesses in the base member are arranged at the side of the packaging so that the closure lid can be clamped into the recesses of the base member for receiving the bearing pins from the side of the packaging. The present invention also provides for a positive-locking connection between the base member and the closure lid which is destroyed upon first actuation of the closure lid.

While clamping of the closure element into the base member according to DE 44 09 947 C2 is carried out from above, the solution according to the invention has the advantage that a too strong loading of the closure lid does not result in detachment thereof from the base member, as can be sometimes the case with the known pouring element of the prior art. An undesirable "levering" of the closure lid is thus reliably excluded.

The positive-locking connection between the base member and the lid element, which is destroyed upon the first participation of the closure lid, forms a "tamper-proof closure" for the pouring element. Such a tamper-proof closure makes it possible that the consumer can immediately detect on a flat gable top packaging provided with such a reclosable pouring element whether it is has already been opened once or not. This is a welcome solution with respect to reasons of hygiene but also with respect to safety considerations since in the past few years poisoned foodstuffs have unfortunately been detected more frequently.

In an advantageous embodiment, the pouring element according to the invention furthermore has a circumferential seal which can be arranged on the base member and/or the closure lid. By means of such a seal it is ensured that the packaging, once opened, can be shaken, with the pouring element being closed, for mixing the contained product without the product leaking from the packaging. The circumferential seal can also be formed by corresponding flanges which are produced as monolithic parts of the base member and/or the closure lid. Preferably, the base member and closure lid are locked by a hook etc. in the closed position in order to prevent an accidental opening. A locking action that can be felt and preferably also heard provided the consumer with an increased feeling of safety during use.

According to a further teaching of the invention, the pouring element is closed before its first use at least in the area of its product-guiding parts so as to be dust-tight.

For this purpose, the base member can be provided with a pull-off lid which is formed as a unitary part on the base member via connecting elements that serve as a rated break point and is connected detachably on the front part of the closure lid positioned in the closed position. As an alternative, the base member can also be provided with a self-adhesive cover foil that is removable before the first use. This prevents reliably a soiling of the parts that are in contact with the product during pouring. This is especially important in context with aseptic packagings because they are subjected over a long period of time to environmental influences as a result of their extended shelf live.

Moreover, this pull-off lid can also be embodied such that it provides at the same time a tamper-proof closure.

In a further embodiment of the invention, the base member comprises at least one stay bridging the area of its pouring opening. Such a stay not only serves to stiffen the pouring element but also as a stop in order to limit the pivot movement of the closure lid to an angle of approximately 90° during opening of the packaging. In this manner, it will be apparent, even to a consumer who has never used such a pouring element before, that the opening process is completed because of the resistance resulting from reaching the stop.

The invention also relates to a flat gable top composite packaging wherein the composite has at least one support layer of paper or carton and on both sides a plastic coating of polyethylene (PE), with an opening surface provided within the packaging gable which after separation provides a pouring opening and is especially advantageously provided with a pouring element according to the invention. It is easily understood that in this context not only such packagings with folded-over gable seams are suitable to receive the pouring element according to the invention, but that the pouring element according to the invention can be applied to all liquid packagings.

BRIEF DESCRIPTION OF THE DRAWINGS

In the following, the invention will be explained in more detail with the aid of preferred embodiments represented in the drawing. The drawing shows in:

FIG. 4 the pouring element of FIG. 1 in longitudinal section, in the open position;

FIG. 5 a further embodiment of the pouring element according to the invention (without inserted closure lid) in a plan view; and FIG. 6 the pouring element of FIG. 5 in a perspective representation.

DETAILED DESCRIPTION OF THE PREFERRED EMBODIMENT

Figure 1:
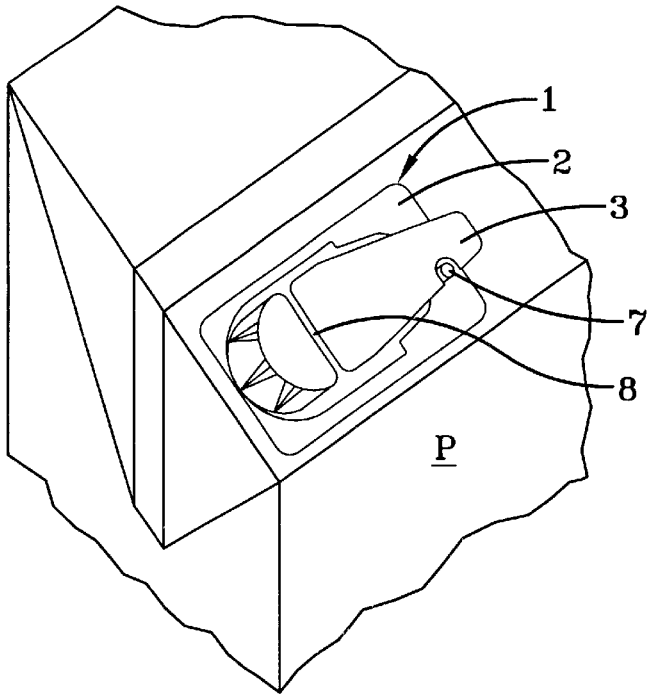
FIG. 1 a reclosable pouring element according to the invention in a perspective view, applied to a flat gable top composite packaging.

In FIG. 1 the pouring element 1 according to the invention is illustrated in a perspective view. The pouring element 1 has a base member 2 to be applied to a flat gable top composite packaging P, shown only partially, and a closure lid 3 for penetrating the packaging wall in a prepared weakened zone of the packaging P and for a subsequent reclosing of the pouring element 1.

Figure 2:
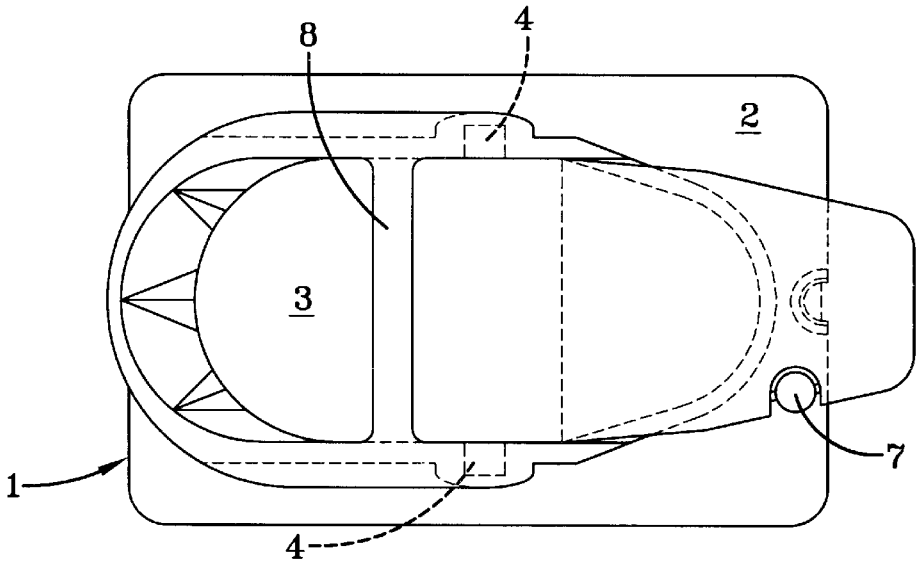
FIG. 2 the pouring element of FIG. 1 in a plan view.
Figure 3:
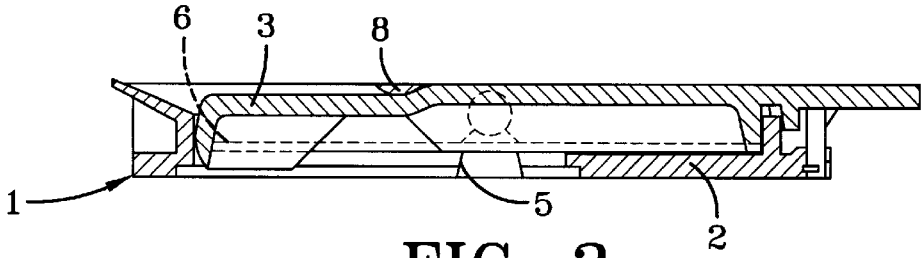
FIG. 3 the pouring element of FIG. 1 in longitudinal section.

As can be seen especially in FIGS. 2 and 3, the closure lid 3 is supported so as to be pivotable about an unidentified axis in the base member 2 of the pouring element 1. The support of the closure lid 3 on the base member 2 of the pouring element 1 according to the invention is characterized in that the lateral bearing pins 4 can be clamped from below, i.e., from the (later) pack side into recesses 5 provided on the base member 2 of the pouring element 1. In this manner, an accidental levering of the closure lid 3 from the base member 2 of the pouring element 1 can be reliably prevented. A stay 8 provides a stop for the closure lid 3 in its open position.

FIG. 3 shows that the closure lid 3 is preferably provided with a circumferential seal 6 which, formed as a circumferential unitary flange, provides a reliable sealing action between the closure lid 3 and the base member 2 in the closed position.

Since the reclosable pouring elements 1 of this kind are usually of a two-part construction, it is provided according to the invention that between the base member 2 and the closure lid 3 a positive-locking connection is provided which is destroyed, upon first actuation of the closure lid 3. In the illustrated and accordingly preferred embodiment, the base member 2 has a spike 7 for this purpose which, after assembly of the base member 2 and the closure lid 3, is deformed preferably with heat application and/or is connected with the closure lid 3 positioned in the closed position and forms in this area a rated break point. In this manner, the user of a flat gable top packaging designed accordingly can immediately detect by means of the intact rated break point (tamper-proof closure) that the packaging and thus the contained product have not been tampered with.

In FIG. 4 the afore-described pouring element according to the invention is represented in the open position in longitudinal section.

FIG. 5 shows a further embodiment of the pouring element 1' according to the invention. It differs from the previously described pouring element 1 in that at the front in the area of the unidentified pouring lip a pull-off lid 10 is fastened by means of connecting elements 9, which are formed as narrow stays, wherein the pull-off lid, after insertion of the closure lid 3', is folded over the closure lid in the closed state in order to seal in a dust-tight way the forward part of the base member 2' which comes into contact with the product upon pouring. Expediently, this pull-off lid is attached with one or more welding point(s) 11 in the area before the stay 8 and the end of the pull-off member 10 is formed as a tap which allows easy removal of the pull-off lid 10. It is understood that the connecting elements 9 as well as the welding points 11 are dimensioned such that an easy removal of the pull-off lid 10 is reliably ensured. FIG. 5 also shows an example embodiment of a self-adhesive cover foil 13 that is detachable before the first use of the pouring element. FIG. 6 shows finally element 1' in its state applied to the packaging P'.

What is claimed is:

1. A reclosable pouring element with a base member and a closure lid, which serves as an opening means, wherein a flange surrounding an opening surface of the pouring element is fixedly connected with a flat gable top composite packaging, and wherein the closure lid has lateral bearing pins which are supported in corresponding recesses of the base member, characterized in that the recesses are arranged in the base member at the packaging side so that the closure lid can be clamped into the recesses for receiving the bearing pins provided in the base member from the packaging side and in that between the base member and the closure lid a positive-locking connection is provided which will be destroyed upon first actuation of the closure lid.

2. The pouring element according to claim 1, characterized in that the base member and/or the closure lid have a circumferential seal.

3. The pouring element according to claim 1, characterized in that the pouring element, before a first use, is closed in a dust-tight manner at least in an area of said pouring element coming in contact with a product poured from said packaging.

4. The pouring element according to claim 3, characterized in that the base member is provided with a pull-off lid which is formed as a unitary part on the base member by means of at least one connecting element serving as a rated break point and is detachably fastened on a front part of the closure lid while said closure lid is in a closed position.

5. The pouring element according to claim 3, characterized in that the pouring element is provided with a self-adhesive cover foil which is detachable before the first use.

6. The pouring element according to claim 1, characterized in that the base member has at least one stay bridging the area of the pouring opening.

7. The pouring element according to claim 1, characterized in that the closure lid locks at the base member when being closed.

8. A flat gable composite packaging, comprised of: a reclosable pouring element according to claim 1 and a composite comprised of at least one support layer of paper having a first side and a second side wherein said first side and said second side of said composite have a plastic coating of polyethylene (PE), wherein an opening surface is provided in a top of said packaging which forms a pouring opening after perforation of said composite.

9. A reclosable pouring element comprised of:

a base member having a pull-off lid providing a dust-tight closure; and a closure lid, which serves as an opening means, wherein a flange surrounding an opening surface of said pouring element is fixedly connected with a flat gable top composite packaging;

wherein said pouring element, before a first use, is closed in a dust-tight manner at least in an area of said pouring element coming in contact with a product poured from said packaging;

wherein said pull-off lid is formed as a unitary part on said base member by means of at least one connecting element serving as a rated break point and is detachably fastened on a front part of said closure lid while said closure lid is in a closed position; and wherein said closure lid has lateral bearing pins which are supported in corresponding recesses of said base member, characterized in that said recesses are arranged in said base member at the packaging side so that said closure lid can be clamped into said recesses for receiving said bearing pins provided in said base member from the packaging side and in that between said base member and said closure lid a positive-locking connection is provided which will be destroyed upon first actuation of said closure lid.

10. A reclosable pouring element comprised of:

a base member;

a closure lid, which serves as an opening means; and a self-adhesive cover foil which is detachable before a first use, wherein a flange surrounding an opening surface of said pouring element is fixedly connected with a flat gable top composite packaging;

wherein said pouring element, before a first use, is closed in a dust-tight manner by said self-adhesive cover foil at least in an area of said pouring element coming in contact with a product poured from said packaging; and wherein said closure lid has lateral bearing pins which are supported in corresponding recesses of said base member, characterized in that said recesses are arranged in said base member at the packaging side so that said closure lid can be clamped into said recesses for receiving said bearing pins provided in said base member from the packaging side and in that between said base member and said closure lid a positive-locking connection is provided which will be destroyed upon first actuation of said closure lid.

11. A reclosable pouring element comprised of:

a base member having at least one stay bridging the area of a pouring opening; and a closure lid, which serves as an opening means, wherein a flange surrounding an opening surface of said pouring element is fixedly connected with a flat gable top composite packaging; and wherein said closure lid has lateral bearing pins which are supported in corresponding recesses of said base member, characterized in that said recesses are arranged in said base member at the packaging side so that said closure lid can be clamped into said recesses for receiving said bearing pins provided in said base member from the packaging side and in that between said base member and said closure lid a positive-locking connection is provided which will be destroyed upon first actuation of said closure lid.

* * * * *